United States Patent [19]

Kalisiak

[11] Patent Number: 5,028,040

[45] Date of Patent: Jul. 2, 1991

[54] APPARATUS AND METHODS FOR VERIFYING REGISTRATION OF FORM PARTS AND FORMS THEREFOR

[75] Inventor: Michael S. Kalisiak, North Tonawanda, N.Y.

[73] Assignee: Moore Business Forms, Inc., Grand Island, N.Y.

[21] Appl. No.: 462,085

[22] Filed: Jan. 8, 1990

[51] Int. Cl.[5] ..... B65H 39/00

[52] U.S. Cl. ..... 270/52; 281/2; 493/11

[58] Field of Search ..... 270/21.1, 52, 52.5, 270/56; 226/2, 27, 45, 100; 281/2; 493/37, 11, 13, 14

[56] References Cited

U.S. PATENT DOCUMENTS

| | | | |
|---|---|---|---|
| 3,788,536 | 1/1974 | Brown | 281/2 |
| 4,030,720 | 6/1977 | Jones | 270/61 |
| 4,137,528 | 1/1979 | Traise | 340/675 |
| 4,477,103 | 10/1984 | Bertolazzi | 281/2 |
| 4,542,893 | 9/1985 | Clause, Jr. et al. | 270/52 |
| 4,578,052 | 3/1986 | Engel et al. | 493/11 |
| 4,680,205 | 7/1987 | Lerner | 226/45 |
| 4,760,574 | 7/1988 | Budworth et al. | 371/5 |
| 4,839,674 | 6/1989 | Hanagata | 226/3 |

FOREIGN PATENT DOCUMENTS

| | | | |
|---|---|---|---|
| 160861 | 10/1982 | Japan | 270/56 |

*Primary Examiner*—Edward K. Look
*Assistant Examiner*—Therese M. Newholm
*Attorney, Agent, or Firm*—Nixon & Vanderhye

[57] ABSTRACT

Apparatus and methods are provided for ensuring predetermined lengthwise registration of interstacked form parts forming a unitary form. The form includes a continuous web comprised of longitudinally adjacent forms, each having a pair of transversely adjacent form parts. Each form part has a registration mark identifying the form parts as parts of a first form. Each registration mark has discrete portions including a count portion which specifically identifies the form parts as part of a predetermined form of a predetermined plurality of forms. When the form parts are interstacked, the registration marks are sensed to determine the accurate transverse alignment of the interstacked form parts and provide an error signal in response to a sensed lack of registration of the corresponding form parts.

11 Claims, 5 Drawing Sheets

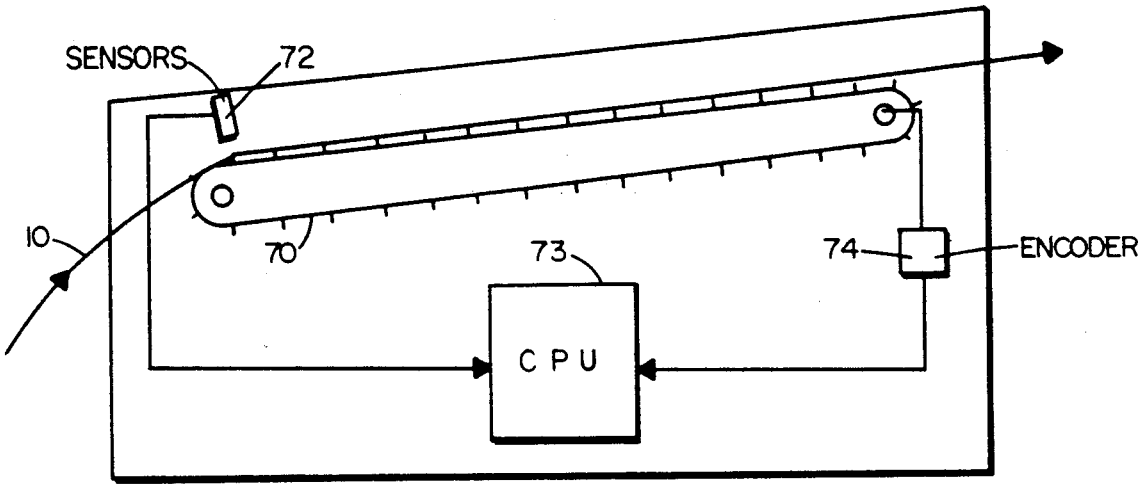
FIG. 5
FIG. 6
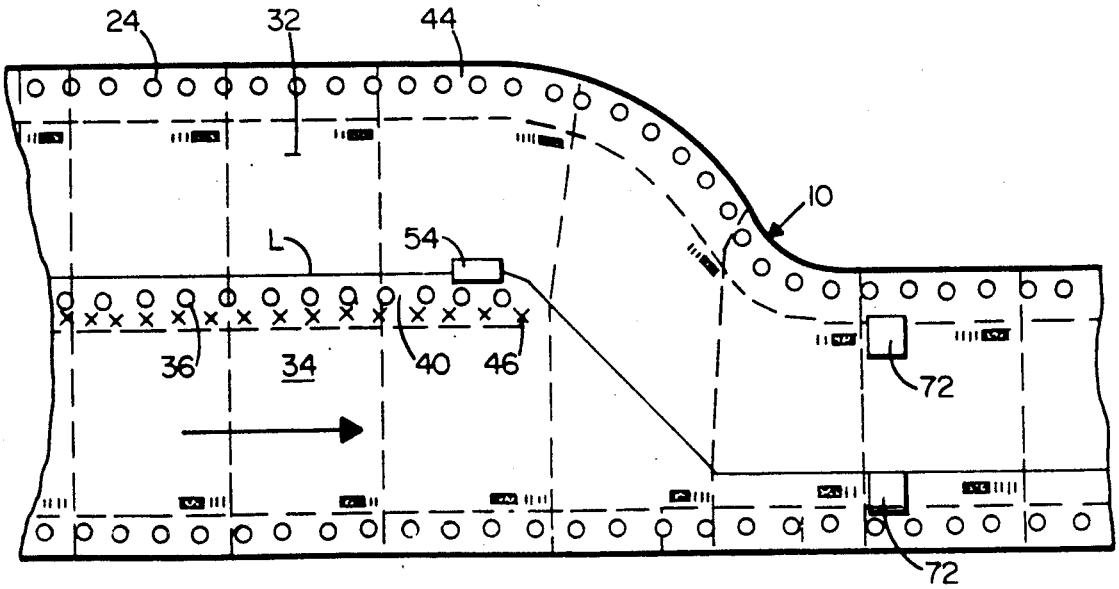

IN
94
BETWEEN SETS ?
Y
OUT
N
C
96
OVER LEFT WINDOW MARK ?
Y
N
98
OVER RIGHT COUNT MARK ?
Y
INCREMENT RIGHT COUNT
N
97
C
D
100
OVER RIGHT WINDOW MARK ?
Y
101
106
OVER LEFT COUNT MARK ?
Y
INCREMENT LEFT COUNT
N
108
MARK COUNTS EQUAL ?
N
A
N
D
Y
CLEAR COUNTS
IDLE: BETWEEN
OUT

APPARATUS AND METHODS FOR VERIFYING REGISTRATION OF FORM PARTS AND FORMS THEREFOR

BACKGROUND OF THE INVENTION

The present invention relates to a multi-part business form having form parts which may be interstacked (one form part overlapping another) and more specifically, to apparatus and methods for verifying registration of the form parts and to the forms therefor.

Presently, there is a need for a business form which is capable of being processed through a non-impact printer so that information can be printed on various, selected parts of the form, but which uses image transfer techniques for the addition of still further information to the form by an impact printer, or by manual means, such as a typewriter, etc. A business form of that type is described and illustrated in co-pending application Ser. No. 07/331,302, filed Mar. 31, 1989, entitled "Multiple Part Form for Non-Impact Printer and Related Process," of common assignee herewith, the disclosure of which is incorporated herein by reference.

The form of that invention can be processed through a non-impact printer, without activating the image transfer means, and thereafter rearranged so that cooperating pressure or impact responsive image transfer means are in position to transfer information applied to one sheet onto an underlying sheet.

More particularly, in that invention, a continuous web is divided into successive forms in a conventional manner by longitudinally spaced, transverse lines of perforations. A first longitudinally extending line of perforations is provided substantially centrally of the web (or to one or the other side of center, depending on desired form configuration) to define a stub portion when the web is subsequently slit longitudinally along a parallel indicator line, to thereby separate the web into first and second, transversely adjacent form parts. In accordance with that invention, the lower surface of the first form part is provided with a coating of carbonless microcapsules containing a liquid fill comprising a chemically reactive color-forming precursor, referred to as a CB (coated back) coating. At the same time, the upper surface of the adjacent or second form part is provided with a dry co-reactant resin coating referred to therein as a CF (coated front) coating. The CB and CF coatings comprise carbonless image transfer means of the type disclosed in U.S. Pat. No. 4,199,174.

Longitudinally extending feed holes are also provided along each marginal edge of the continuous web so that the web may be engaged by a conventional tractor drive mechanism for feeding the web through one or more processing stations. A third intermediate and longitudinally extending line of feed holes is provided adjacent the first longitudinal perforation line. In addition, a longitudinally extending glue line, for example, a heat seal type adhesive, is provided along, and inside, one marginal line of feed holes, but outside a second longitudinally extending perforation line, which defines a marginal stub portion. This type of form permits variable information to be applied to one or both form parts in a non-impact printer as the form passes therethrough in a two-wide (side-by-side), single-ply configuration. Subsequently, as briefly mentioned above, the web may be engaged by a conventional slitting mechanism which separates the form parts along the slit indicator line, a line adjacent the third, intermediate line of feed holes, but on the opposite side thereof, vis-a-vis the first longitudinal perforation line. Thus, two webs are formed with the form parts in each web remaining connected one to the other in the direction of web travel and with the form parts of each form lying transversely adjacent one another.

The separated parts are then interstacked by a conventional interstacking device, such that the first, and now upper, form part overlies the second, and now lower, form part so that the third intermediate (now marginal) line of feed holes of the lower form part are vertically aligned with the marginal feed holes of the upper form part. In that configuration, the CB coating on the back of the upper form part is in full surface engagement with the CF coating on the front of the lower form part so that, subsequently, information applied to the upper form part will be imaged onto the lower form part, through the interaction of the CB and CF coatings. After the form parts are interstacked and aligned, the heat-seal adhesive is activated to secure the respective form parts together.

The present invention relates to apparatus and methods relating to registration marks applied to the form for ensuring that the corresponding transversely adjacent form parts, when the webs and hence form parts are interstacked, lie in lengthwise registration with one another. The present invention also relates to the form on which the registration marks are applied. For purposes of this application, the form parts are in registration or registry with one another when the form parts are properly interstacked with appropriate perforation lines and tractor pin openings in alignment, and when the registration marks are aligned. Thus, the apparatus and methods, as well as the form, hereof are provided to ensure that when the form is slit lengthwise and the webs overlapped, both form parts of a form set lie in a predetermined lengthwise registration one with the other, i.e., are not misaligned in the lengthwise direction. In this application, lengthwise means the direction of the movement of the forms or form parts during manufacture including printing.

To accomplish the foregoing, a set of registration marks are provided on each of the form parts, preferably adjacent the left and right marginal edges of the form. The registration marks are applied to the form in transverse or lateral alignment with one another. The marks may be pre-printed on-line by a press or by an off-line printer. Each registration mark is comprised of discrete portions including a window mark portion and a count mark portion spaced lengthwise one from the other. Each of a predetermined sequentially arranged number of forms has a different set of registration marks, including a different number of counts in the count portion of the mark, such that a repeat of the count portion of the registration mark does not occur until several sets of marks and, hence, forms are moved past a sensing station, to be described. For example, the first set of registration marks in one form may have two counts in its count portion, with the succeeding marks in the next forms having three and four counts in their count portions, respectively, before the next set of two-count registration marks in the next form constitutes a repeat.

Preferably, by design the registration marks of each set thereof are complementary to one another. For example, one registration mark along one marginal edge of the form may have its window portion leading a trailing count portion while the other registration mark along the opposite marginal edge of the form may have its count portion leading a trailing window portion. In this manner, the forms can be run in opposite directions and the sensing apparatus hereof senses the marks when the forms are run in either direction. Additionally, there is a finite gap between the end of the leading window portion of the registration mark and the beginning of the window portion of the other registration mark of that set. Furthermore, the count portion of each set falls totally within the length of the window portion of the other registration mark of that set.

The apparatus for ensuring proper interstacking of the form parts includes a form conveyor having a plurality of tractor pins along its opposite sides for engaging the pin feed holes along one side of the form and the overlapped registering pin feed holes adjacent the other side of the interstacked form. An optical sensor is provided overlying the path of travel of each of the registration marks along the conveyor for detecting the registration marks. An encoder is provided to sense the rate, displacement and direction of travel of the conveyor and a microprocessor (CPU) is provided to compare the sensed registration marks and also to correlate them with the signals from the encoder in a manner set forth hereinafter.

The optical sensors are disposed to scan the path of travel of the registration marks when the interstacked form parts are located on the conveyor. When the first mark in a set appears under either sensor, its length is monitored. If the length is determined by the CPU to be longer than a predetermined length, it is taken as a window mark. Simultaneously, the opposite sensor scans the other registration mark of the set, particularly the count mark portion, and the count is stored by the CPU. Upon further movement of the form, the count mark portion of the first registration mark of that set is then sensed and the number of counts is stored in the CPU. Simultaneously, the window area of the second registration mark of that set is likewise sensed. After the second window mark passes the sensor, the two counts are compared. If the counts are the same, the form parts must lie in lengthwise registry. If they differ, an error signal is generated by the CPU and the conveyor is stopped. The CPU is programmed such that various error conditions may be noted and the conveyor stopped. For example, when no marks are sensed within the maximum length of the interstacked form, an error signal is generated which stops the conveyor. When the counts from the two form parts do not compare or are not equal, the CPU generates an error signal to stop the conveyor. Additionally, when the second window mark is not sensed within a predetermined distance of the end of the first window mark, an error signal is generated to likewise stop the conveyor.

In a preferred embodiment according to the present invention, there is provided a method for ensuring predetermined lengthwise registration of at least partially superposed form parts forming a form, comprising the steps of providing first and second form parts, each having a registration mark identifying the first and second form parts as parts of a first form, overlapping portions of the first and second form parts and sensing the registration marks of the overlapped first and second form parts to determine a characteristic thereof and providing output signals responsive thereto. Predetermined criteria are established for comparing the sensed characteristics of the registration marks. The output signals are compared and an error signal is provided in response to a comparison of the sensed characteristics of the registration marks in the event the sensed characteristics do not compare according to the predetermined criteria, thereby indicating a lack of registration of the first and second form parts.

In a further preferred embodiment according to the present invention, there is provided a form for use in interstacking form parts thereof comprising first and second form parts attached to one another and severable one from the other to provide discrete form parts for interstacking one with the other. Each form part carries a registration mark for ensuring predetermined lengthwise registration of the interposed form parts, with each registration mark including a pair of discrete mark portions spaced one from the other in the lengthwise direction, the registration mark on one of the form parts being the complement of the registration mark on the other of the form parts.

In a further preferred embodiment according to the present invention, there is provided apparatus for interstacking form parts of a continuous form web and ensuring predetermined lengthwise registration of at least the partially superposed form parts forming a form comprising means for conveying a form web in a predetermined direction of travel, the form web having a plurality of forms spaced one from the other in the direction of web travel, with each form having a pair of transversely spaced first and second form parts. Means are provided for separating and interstacking the form parts and for sensing a registration mark on each of the first and second form parts identifying the first and second form parts as parts of a specified form to determine a characteristic thereof and providing an output signal in response thereto. Means are also provided for establishing a predetermined criteria for comparing the sensed characteristics of the registration marks. Finally, means for comparing the output signals and providing an error signal in response to a comparison of the sensed characteristics of the registration marks in the event the sensed characteristics do not compare according to the predetermined criteria are also provided, thereby indicating a lack of registration of the first and second form parts.

Accordingly, it is a primary object of the present invention to provide novel and improved apparatus and methods for verifying registration of interstacked form parts and the forms therefor.

These and further objects and advantages of the present invention will become more apparent upon reference to the following specification, appended claims and drawings.

BRIEF DESCRIPTION OF THE DRAWING FIGURES

FIG. 5 is a schematic illustration of the apparatus employed for sensing the registration marks and generating error signals in response to mis-registration;

FIG. 6 is a schematic plan view of the form as it is being severed to enable interstacking of the form parts.

DETAILED DESCRIPTION OF THE DRAWING FIGURES

Reference will now be made in detail to the present preferred embodiment of the invention, an example of which is illustrated in the accompanying drawings.

Referring now to FIGS. 1–4, an exemplary embodiment of the form of the present invention bearing the registration marks hereof is illustrated. The form includes a continuous paper web 10 with longitudinally spaced, transverse lines of perforations 12 which define successive forms 14, 16, 18 and 19. Since the forms are identical, only one need be described further.

Figure 3:
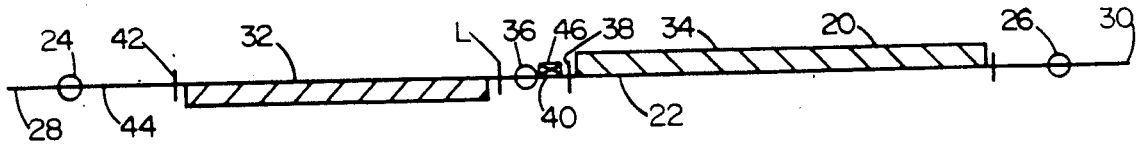
FIG. 3 is a schematic cross-sectional view taken generally about on line 3—3 in FIG. 1 and taken in the direction of travel of the form as indicated by the arrow in FIG. 1.
Figure 4:
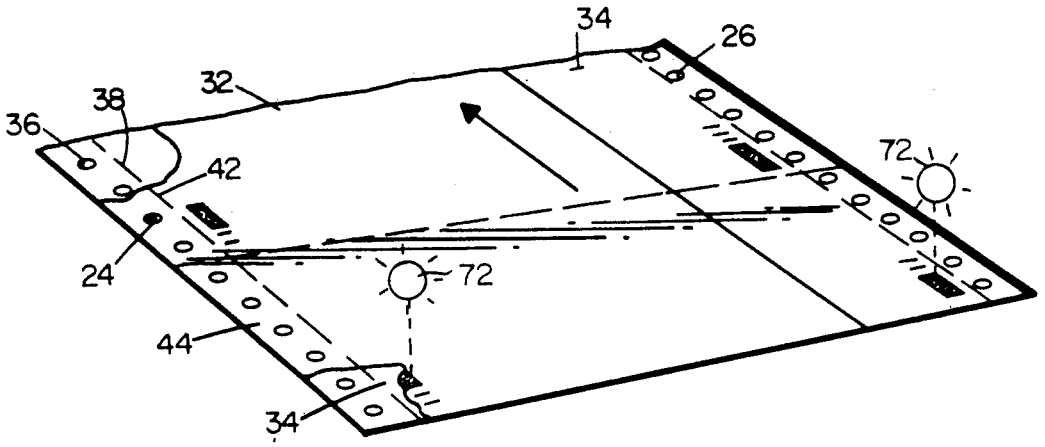
FIG. 4 is a perspective view of the form parts of a single form interstacked and disposed below the sensors for sensing the registration marks.

The form 16, for example, has an upper surface 20 and a lower surface 22 (FIG. 3). Longitudinally spaced feed holes 24, 26 are provided along each marginal edge 28, 30, respectively, for engagement with suitable tractor drive pins (or belts or the like) in a conventional manner.

The web is divided into first and second side-by-side form parts 32, 34, for example, along an indicator line L extending longitudinally of the web, intermediate the longitudinal edges 28, 30. It will be appreciated that the precise location of the indicator line may be varied, depending on form configuration and that it may be omitted entirely because it only indicates the line lengthwise of the form through which the form is slit to provide discrete form parts 32 and 34. It will further be appreciated that while the indicator line L facilitates lateral adjustment of the slitting mechanism to the desired location, other suitable means may be employed for this purpose, so that line L, for purposes of describing this invention, may be real or imaginary.

A third, intermediate line of feed holes 36 extends along web 10, intermediate the marginal feed holes 24, 26, and generally adjacent the indicator line L, for a purpose explained below. Adjacent the intermediate line of feed holes 36, but on the side opposite the indicator line L, there is provided a first longitudinally extending perforation line 38, thereby defining a stub portion 40 upon separation of the form parts along line L.

A second longitudinally extending perforation line 42 is provided on form part 32 laterally inwardly of the line of feed holes 24, to form a marginal stub portion 44 along edge 28. It will be understood that a third longitudinally extending perforation line may be provided adjacent feed holes 26 to create a similar marginal stub portion along edge 30 if desired. As explained in greater detail below, upon separation and interstacking of form parts 32 and 34, the stub portions 40, 44 and respective lines of feed holes 36, 24 will be vertically aligned.

With reference to FIG. 3, on the upper surface 20 of form part 34, located between the feed holes 36 and perforation line 38, is a line 46 of heat seal (or other) adhesive for a purpose described further below. Depending on the particular form configuration, the adhesive may be located elsewhere, for example, on lower surface 22 of form part 32.

While the present invention need not necessarily have information transfer means forming an integral part of the form, most presently considered uses of the form utilize a carbonless information transfer mechanism on the form. For example, the lower surface 22 of form part 32 is provided with a CB coating extending substantially over the entire surface of the form part, from edge 48 just inside the second perforation line 42 across the width of the form part to the slit line L adjacent the centrally located line of feed holes 36. The upper surface 20 of form part 34 is provided with a CF coating over substantially its entire surface, extending across the width of the form from an edge between feed holes 36 and the first perforation line 38, to an edge adjacent and just inside the feed holes 26.

With reference now to FIG. 6, a web processing line, for advancing the web in the direction of the arrow, is schematically illustrated wherein the web 10 is fed longitudinally past a slitting mechanism 54 and slit along the indicator line L to longitudinally separate the web into the respective form parts 32, 34. The slitting mechanism is a conventional device which need not be described in detail. Just beyond the slitting mechanism, the respective form parts are interstacked, i.e., form part 32 is moved laterally over the form part 34 by a conventional interstacker so that the parts are in overlying relationship, with stub portions 44, 40 and respective feed holes 24, 36 in vertical alignment. Before the form parts are fed to additional processing stations, such as a sealer, not shown, where the marginal stub portion 44 on the form part 32 is sealed via adhesive line 46 to the stub portion 40 of the lower form part 34, the interstacked forms are forwarded to a conveyor system where the lengthwise registration of the interstacked forms are checked or verified.

Referring back to FIGS. 1 and 2, each form 14, 16, 18, 19, etc., is provided with a set of registration marks, generally designated 60. Marks 60 are provided on each form part 32 and 34, preferably adjacent the extreme lateral edges of the form, such that when form parts 32 and 34 are interstacked, the registration marks 60 of each set will lie adjacent opposite sides of the interstacked form parts.

Figure 2:
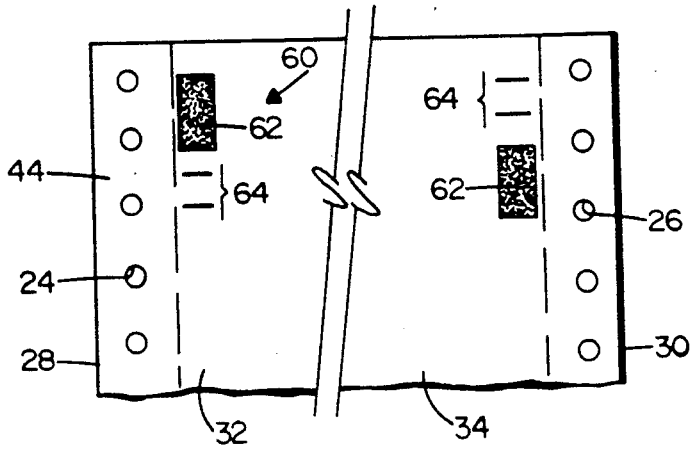
FIG. 2 is a fragmentary enlarged plan view of the form illustrated in FIG. 1 and illustrating one form with the registration marks in lengthwise registration one with the other.

Each registration mark 60 comprises two discrete portions, i.e., a window portion 62 and a count portion 64 (brackets being used in FIG. 2 to designate collectively the count marks in each count portion 64). In a preferred form, window portion 62 comprises essentially a solid mark of finite length in the direction of movement of the interstacked forms. The count portion 64 comprises one or more individual marks, which can be counted by sensors as the interstacked forms advance along a conveyor below the sensors, as described hereinafter. Significantly, the count portions are contained within the same finite length as the window portions (transversely aligned with one another) and it will be noted that there is a finite gap between the end of the window portion and the beginning of the window portion of the other registration mark of that set of marks in the direction of travel. Additionally, the registration marks of each set are the complement of one another, as best illustrated in FIG. 2. That is, the registration mark 60 on form part 32 has a leading mark portion comprising window portion 62 and a trailing portion comprising the count portion 64. The registration mark 60 on the form part 34 of the same form, however, leads with the count portion 64 followed by the window portion 62. Note that count portion 64 lies within the lengthwise confines of the window portion 62 on the corresponding form part. Also, the window marks are all the same length in the web direction.

Figure 1:
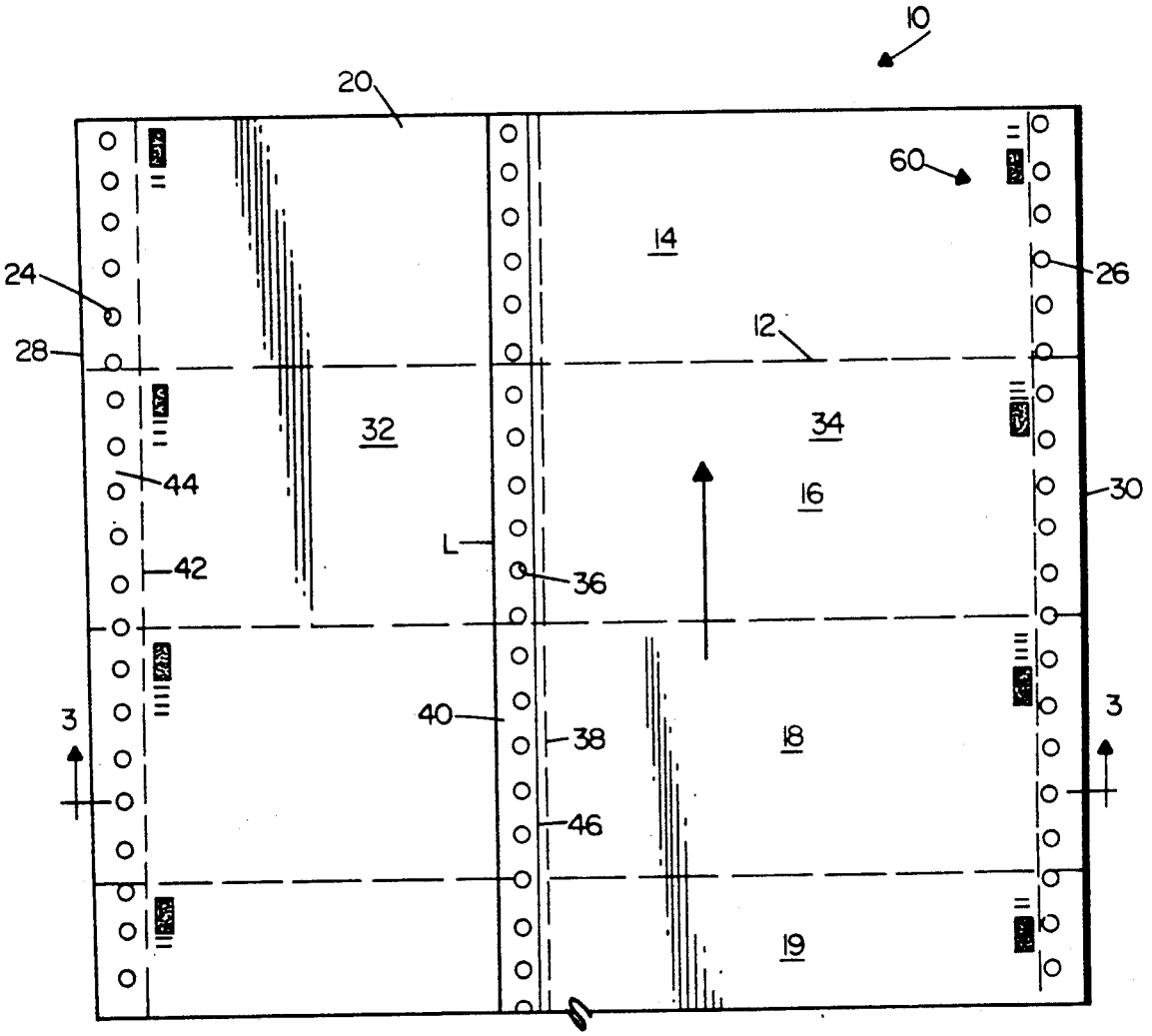
FIG. 1 is a plan view of a plurality of sequentially arranged forms of the present invention, each comprised of two transversely adjacent form parts bearing registration marks.

It will also be appreciated that the registration marks on succeeding forms have different count portions before a repeat of the count portion of any one of the marks occurs. For example, the form 14 has two counts, succeeding form 16 has three counts, and succeeding form 18 has four counts, before the count portions of the marks on form 14 are repeated on the next form 19, as best illustrated in FIG. 1. Thus a predetermined number of forms with registration marks having different counts will pass the sensors before an additional form passes the sensor having the same number of counts.

Referring now to FIG. 5, there is illustrated a conveyor 70 having tractor pins for engaging in the pin feed holes of the interstacked forms, i.e., engaging in the vertically registering pinholes 24 and 36 and the pinholes 26 on opposite sides of the interstacked form parts. Adjacent the leading end of conveyor 70, there is provided a pair of optical sensors 72 that are laterally aligned with the path of travel of the registration marks 60 of the interstacked form parts for detecting the window and count portions of the marks. The sensors are coupled to a microprocessor 73. The sensors 72 are visible LED reflective sensors with self-contained amplifiers commercially available from SKAN-A-MATIC Corp. Each emits a cone of red light by an enclosed LED. A background reflectance level is ascertained (conventionally a white background) and the registration marks are less reflective and therefore seen as voids in the reflected light. The amplifiers within the LEDs prepare the output in real time for acceptance by the CPU.

Additionally, an encoder 74 is connected to a shaft on conveyor 70 and provides an output count or pulse indicative of the web travel on conveyor 70. Thus, displacement and direction of web travel are indicated by pulse trains. For example, each count or pulse from encoder 74, coupled to the CPU, will indicate a fixed and constant measurement of web travel of about 1/16 inch. Consequently, information regarding the lengths of the registration marks is provided by encoder 74.

In operation, once the form parts 32 and 34 are interstacked, as previously described, the forms are transferred onto conveyor 70, where their lengthwise registration is verified. Alternatively, the conveyor may form an integral part of the interstacking mechanism. Thus, as the interstacked form parts advance along conveyor 70, the sensor on one side senses the leading window portion of the registration mark, while the opposite sensor senses the count portion 64 of the other registration mark of that set. The length of the window mark is monitored and the CPU determines if such length is longer than a predetermined length, for example, 1/16 inch, whereby the mark is taken as a window mark. As the interstacked form parts advance, the sensors detect the next registration mark portion, i.e., the count portion of the one registration mark, and the window portion of the other registration mark of the first set of registration marks. With the number of counts of the count portion of the one registration mark stored in the CPU, the number of counts of the count portion of the other registration mark is sensed and presented to the CPU. Once the CPU identifies the window portion of the one mark, the window portion of the other registration mark of the first set thereof must appear under the opposite sensor within a predetermined length of travel of the conveyor. If not, the CPU generates an error signal which preferably shuts down the conveyor. Additionally, once both marks are scanned, the number of counts is compared. If the counts compared are not equal, the CPU generates an error signal which shuts down the conveyor. Still further, the CPU will generate an error signal when no marks are sensed within a maximum form length, as well as when the second window mark is not sensed within the predetermined length of travel of the interstacked form parts on the conveyor. Thus, upon detecting any one of these three error conditions, the CPU recognizes that the interstacked form parts are not in lengthwise registration one with the other and generates an error signal, which preferably shuts down the conveyor or otherwise notifies the operator that the interstacked form parts are not in registry one with the other.

Figure 7:
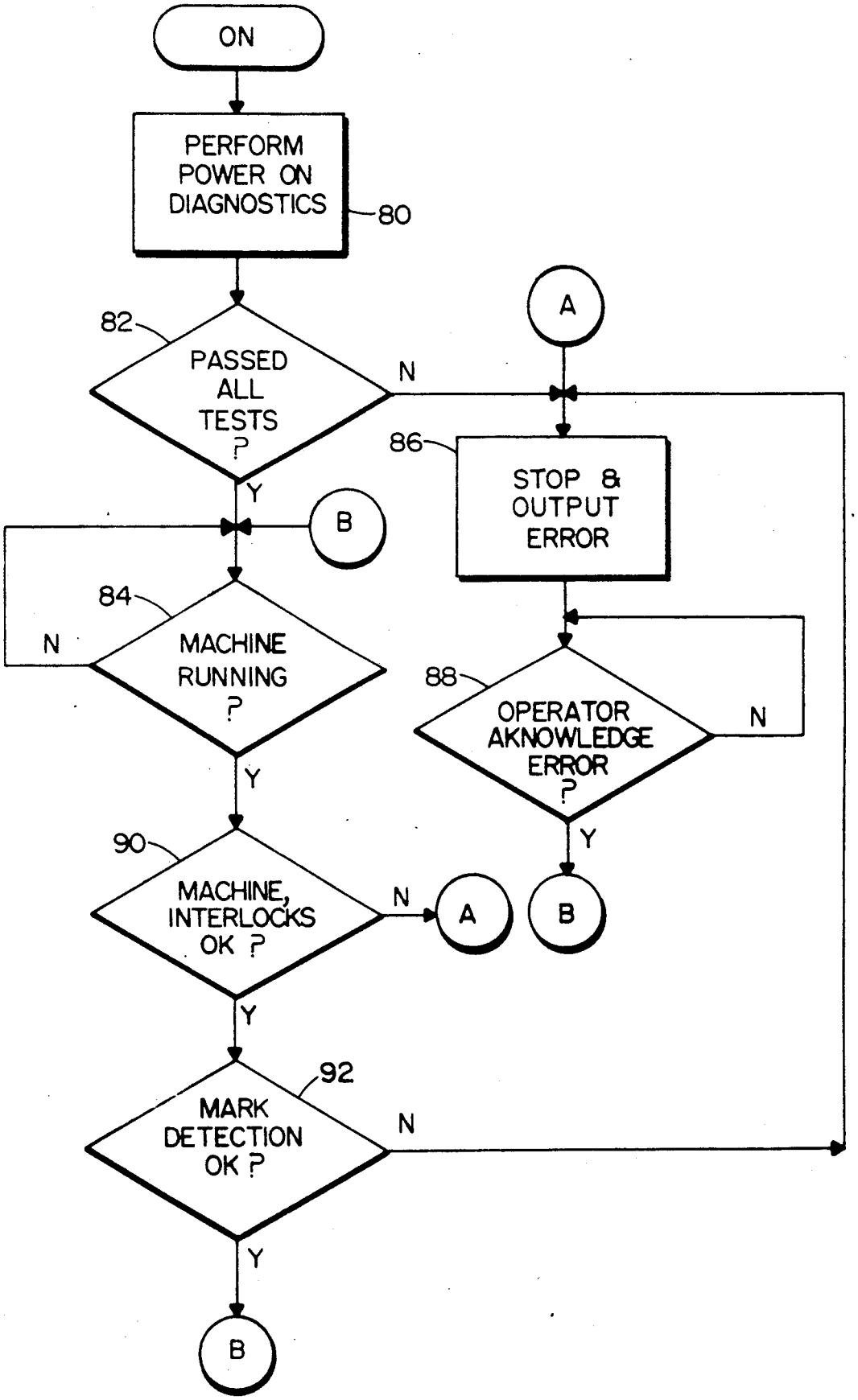
FIGS. 7 and 8 are flow charts indicating the operation of the present invention.

A flow chart indicating the general operation of the apparatus is disclosed in FIG. 7. For example, when CPU 73 is first turned on, it performs various diagnostic tests on the system (block 80). If the system checks out, instructions to run the CPU are passed from decision block 82 to decision block 84. In the event the diagnostic tests fail, CPU 73 stops the further operational sequence at block 86 and an operator at decision block 88 identifies the problem. The operator then cures the problem and the operations instruction sequence continues at decision block 84. With the CPU up and the machine running, the machine interlocks are checked for various operations, such as main and tractor covers closed, tension brushes, heaters and certain auxiliary machines at decision block 90. If the interlocks do not check out, the operational sequence is interrupted and the problem is identified at block 86. Once cured, the running and interlock sequences are again checked. If they check out, the mark detection operations sequence indicated at decision block 92 commences.

Figure 8:
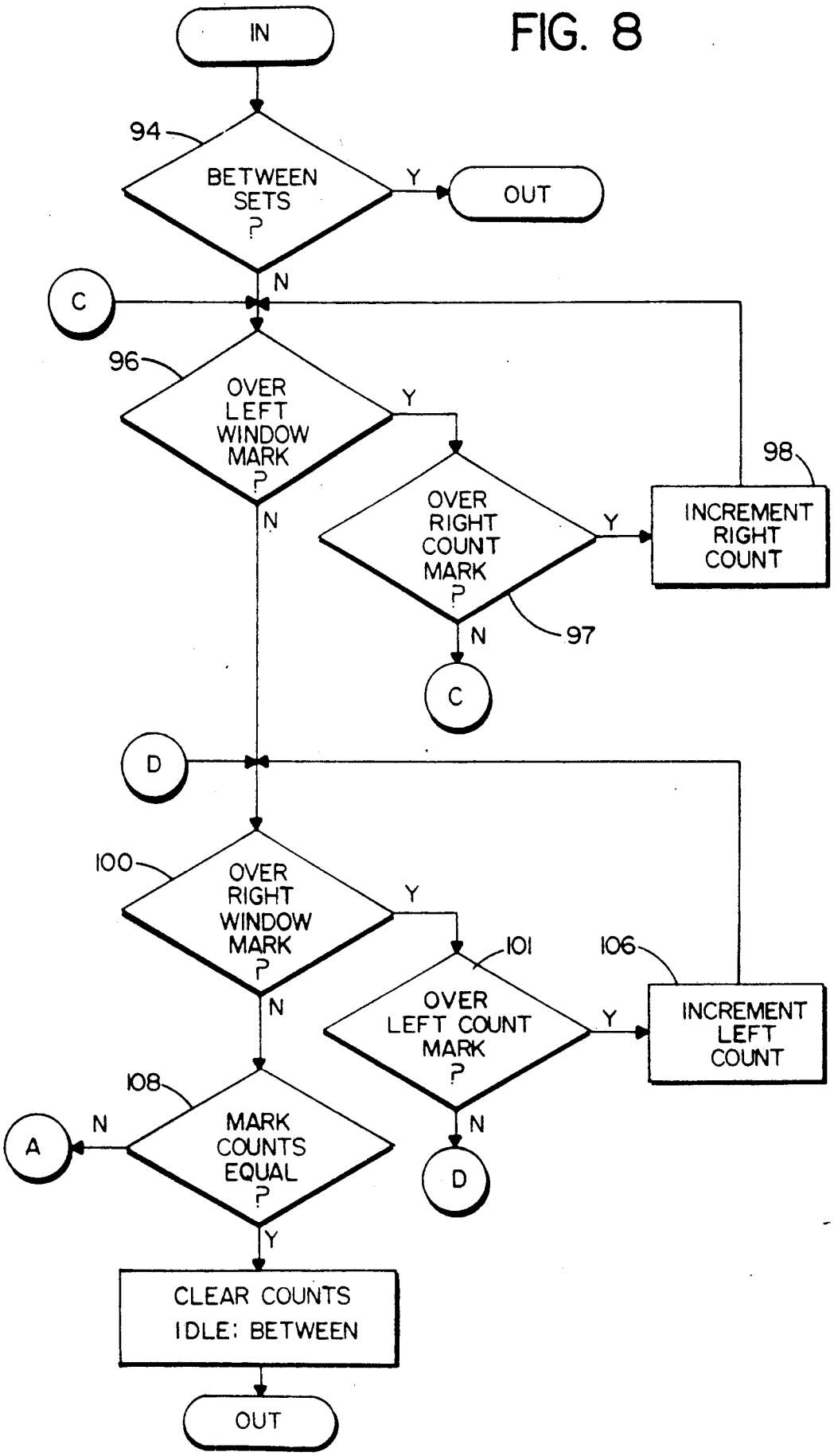

Referring now to FIG. 8, the flow chart for the mark detection operations, i.e., decision block 92, is illustrated. After it has been determined that the forms are ready for interstacking, and the apparatus of FIG. 5 is not between sets, as indicated at decision block 94, the sensor's CPU and encoder 74 commence sensing the registration marks to ensure registration of the form parts. For example, sensor 72 senses the left window mark, at which time the right count mark is sensed to cause an incremental right count to be stored, for example, at block 98. Note that the operation continues only if the left window mark and then the right count mark are sensed as indicated by the decision blocks 96 and 97. Also, the count mark occurs only if the window mark is sensed. The operation continues until the appropriate number of counts for the right count marks are made and stored in the CPU.

Upon further advance of the interstacked form, sensor 72 senses the right window mark followed by a sensing of the left count mark. Continuous sensing of the right window mark and the left count mark results in an incremental left count indicated at block 106, stored in CPU 73. Again, the operation continues only if the right window mark and then the left count mark are sensed as indicated by decision blocks 100 and 101. When no further count marks or window marks are sensed, or the encoder has indicated a predetermined travel of the conveyor, the next decision at block 108 is to determine whether the count marks from the left and right count portions are equal or not. If the count marks are not equal, block 86 requires the generation of an error signal and operator involvement. If the count marks are equal, the CPU clears the count marks awaiting the generation of sensing signals for the next registration marks.

While the present invention is envisioned for processing forms of one length during each run, it will be appreciated that the invention may also process a run of forms of one length and a run of forms of another without any operator input. Additionally, the invention may process forms of different lengths in a single run without operator involvement. No operator involvement is necessary to synchronize the CPU to the marks whereby the marks are auto-initiating.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for ensuring predetermined lengthwise registration of at least partially superposed form parts forming a form, comprising the steps of:

providing first and second form parts, each having a registration mark identifying the first and second form parts as parts of a first form;

overlapping portions of said first and second form parts;

sensing the registration marks of the overlapped first and second form parts to determine a characteristic thereof and providing output signals responsive thereto;

establishing predetermined criteria for comparing the sensed characteristics of the registration marks;

comparing the output signals; and providing an error signal in response to a comparison of the sensed characteristics of the registration marks in the event the sensed characteristics do not compare according to said predetermined criteria, thereby indicating a lack of registration of the first and second form parts.

2. A method according to claim 1, wherein each registration mark includes a count mark indicating one or more counts, the method including the further steps of sensing the count marks of the overlapped first and second form parts to determine the number of counts, comparing the number of sensed counts from each registration mark and providing an error signal in response to the sensed count marks in the event the number of counts are not equal.

3. A method according to claim 2, including a second form adjacent the first form, with said second form including first and second form parts and including the steps of providing the first and second form parts of said second form with registration marks having characteristics different from the characteristics of registration marks provided said first form, sensing the registration marks of the overlapped first and second form parts of said second form to determine a characteristic thereof and providing output signals responsive thereto, comparing the latter output signals, and providing an error signal in response to a comparison of the sensed characteristics of the registration marks on said second form in the event such sensed characteristics do not compare according to said predetermined criteria.

4. A method according to claim 1 including moving the form in a predetermined direction, providing each registration mark with two discrete and different first and second portions spaced one from the other in the direction of movement of the form, with one mark being the complement of the other mark, sensing the first portion of one mark and providing a signal in response thereto, thereafter sensing the second portion of the other mark and providing a signal in response thereto and comparing the latter signals and providing an error signal in response to comparison of the latter signals in the event the sensed first and second portions of the marks do not compare according to said predetermined criteria, thereby indicating lack of registration of the first and second form parts.

5. A form for use in interstacking form parts thereof comprising:

first and second form parts attached to one another and severable one from the other to provide discrete form parts for interstacking one with the other, each said form part carrying a registration mark for ensuring predetermined lengthwise registration of the interposed form parts, each registration mark including a pair of discrete mark portions spaced one from the other in the lengthwise direction, the registration mark on one of said form parts being the complement of the registration mark on the other of said form parts.

6. A form according to claim 5 wherein one of said discrete mark portions of each said mark includes one or more count marks whereby the number of counts in each mark portion may be sensed.

7. A form according to claim 6 wherein the count marks of said one discrete portion have an extent in the lengthwise direction of the form equal to or less than the lengthwise extent of the other of said discrete portions.

8. A form according to claim 5 wherein one of said discrete mark portions of each said mark includes one or more count marks whereby the number of counts in each mark portion may be sensed and the count marks of said one discrete portion have an extent in the lengthwise direction of the form equal to or less than the lengthwise extent of the other of said discrete portions.

9. A form according to claim 5 including a second form adjacent the first form and including first and second form parts attached to one another and severable one from the other to provide discrete first and second form parts for interstacking with one another, each form part of said second form carrying a registration mark for ensuring predetermined lengthwise registration of the unstacked first and second form parts of the second form, each registration mark of said second form including a pair of discrete mark portions spaced one from the other in the lengthwise direction with each such registration mark being the complement of the other, at least one of the discrete portions of the first or second registration marks of the first form having one or more count marks and at least one of the discrete portions of the first or second registration marks of the second form having one or more count marks different from the count marks of said one discrete portion of the first form.

10. Apparatus for interstacking form parts of a continuous form web and ensuring predetermined lengthwise registration of at least the partially superposed form parts forming a form comprising:

means for conveying a form web in a predetermined direction of travel, the form web having a plurality of forms spaced one from the other in the direction of web travel with each form having a pair of transversely spaced first and second form parts;

means for separating and interstacking the form parts;

means for sensing a registration mark on each of the first and second form parts identifying the first and second form parts as parts of a specified form to determine a characteristic thereof and providing an output signal in response thereto;

means for establishing a predetermined criteria for comparing the sensed characteristics of the registration marks; and means for comparing the output signals and providing an error signal in response to a comparison of the sensed characteristics of the registration marks in the event the sensed characteristics do not compare according to the predetermined criteria, thereby indicating a lack of registration of the first and second form parts.

11. Apparatus according to claim 10 including an encoder for determining incremental displacement of the web and providing an output signal responsive thereto, the registration marks including a count mark having one or more counts, said sensing means sensing the count marks of the overlapped first and second form parts to determine the number of counts and said comparing means.

* * * * *